US005947763A

United States Patent [19]

Alaksin

[11] Patent Number: 5,947,763

[45] Date of Patent: Sep. 7, 1999

[54] BI-DIRECTIONAL STAGED CPA

[75] Inventor: Paul H. Alaksin, Warren, Ohio

[73] Assignee: General Motors Corporation, Detroit, Mich.

[21] Appl. No.: 08/971,792

[22] Filed: Nov. 17, 1997

[51] Int. Cl.[6] ..... H01R 3/00

[52] U.S. Cl. ..... 439/489; 439/352

[58] Field of Search ..... 439/488, 489, 439/352, 357

[56] References Cited

U.S. PATENT DOCUMENTS

| | | | |
|---|---|---|---|
| 5,174,786 | 12/1992 | Kato et al. | 439/352 X |
| 5,681,184 | 10/1997 | Pamart et al. | 439/310 X |
| 5,707,248 | 1/1998 | Matsumura | 439/489 |

*Primary Examiner*—Khiem Nguyen
*Attorney, Agent, or Firm*—Patrick M. Griffin

[57] ABSTRACT

The invention includes an electrical connector system having first and second mateable housings and a connector position assurance member for bi-directional sliding movement on the second connector housing. The first connector housing includes a primary lock ramp thereon and the second connector housing has a primary lock constructed and arranged for pivotal movement and for locking against the primary lock ramp when the first and second connector housings are fully mated. The connector position assurance member is slidable on the second connector housing in a direction co-linear with the mating direction of the connector housings to a pre-staged position and so that the primary lock is uninhibited from pivotal movement. The connector position assurance member includes a first lock mechanism that temporarily locks the connector position assurance member from slidable movement on the second connector housing in a direction perpendicular to the mating direction of the connector housings when the connector position assurance member is in the pre-staged position. The first lock mechanism can be disengaged and unlocked when the first and second connector housings are fully mated allowing the connector position assurance member to be slid in a perpendicular direction to a final fully seated position. In the final fully seated position, the connector position assurance member blocks the primary lock from pivotal movement preventing the primary lock from being disengaged from the primary lock ramp.

12 Claims, 4 Drawing Sheets

BI-DIRECTIONAL STAGED CPA

TECHNICAL FIELD

This invention relates to electrical connector systems utilizing connector position assurance components.

BACKGROUND OF THE INVENTION

Connector position assurance components (CPA) are used in an electrical connection system to insure that the two connector halves are fully mated before the CPA can be seated, and after full mating of the connectors, to insure that the connectors stay locked together in the mated position. Recently, staged CPAs have been developed that allow the CPA to be mounted onto the connection system prior to the connection being made between the two connector halves. To accomplish this, the CPA is usually inserted into one of the male or female connector housings and moved in a direction that is either co-linear or perpendicular with the mating direction of the connector housings to a first pre-staged position. Thereafter, the male and female connector housings are mated together and the CPA is moved further forward in the same co-linear or perpendicular direction to a final fully seated position that prevents the connector from being inadvertently unlocked. With the existing unidirectional CPA designs, however, if too much force is used in the initial step of moving the CPA to the pre-staged position, the CPA can be moved passed the pre-staged position to the final fully seated position. This often prevents the male and female connectors from being mated thereafter. If this occurs, it adds labor, cost and time to the assembly process.

The present invention provides alternatives to and advantages over the prior art.

SUMMARY OF THE INVENTION

The invention includes an electrical connector system having first and second mateable housings and a connector position assurance member for bi-directional sliding movement on the second connector housing. The first connector housing includes a primary lock ramp thereon and the second connector housing has a primary lock constructed and arranged for pivotal movement and for locking against the primary lock ramp when the first and second connector housings are fully mated. The connector position assurance member is slidable on the second connector housing in a direction co-linear with the mating direction of the connector housings to a pre-staged position and so that the primary lock is uninhibited from pivotal movement. The connector position assurance member includes a first lock mechanism that temporarily locks the connector position assurance member from slidable movement on the second connector housing in a direction perpendicular to the mating direction of the connector housings when the connector position assurance member is in the pre-staged position. The first lock mechanism can be disengaged and unlocked when the first and second connector housings are fully mated allowing the connector position assurance member to be slid in a perpendicular direction to a final fully seated position. In the final fully seated position, the connector position assurance member blocks the primary lock from pivotal movement preventing the primary lock from being disengaged from the primary lock ramp.

These and other objects, features and advantages of the present invention will become apparent from the following brief description of the drawings, detailed description and appended claims and drawings.

DESCRIPTION OF THE PREFERRED EMBODIMENT

Figure 1:
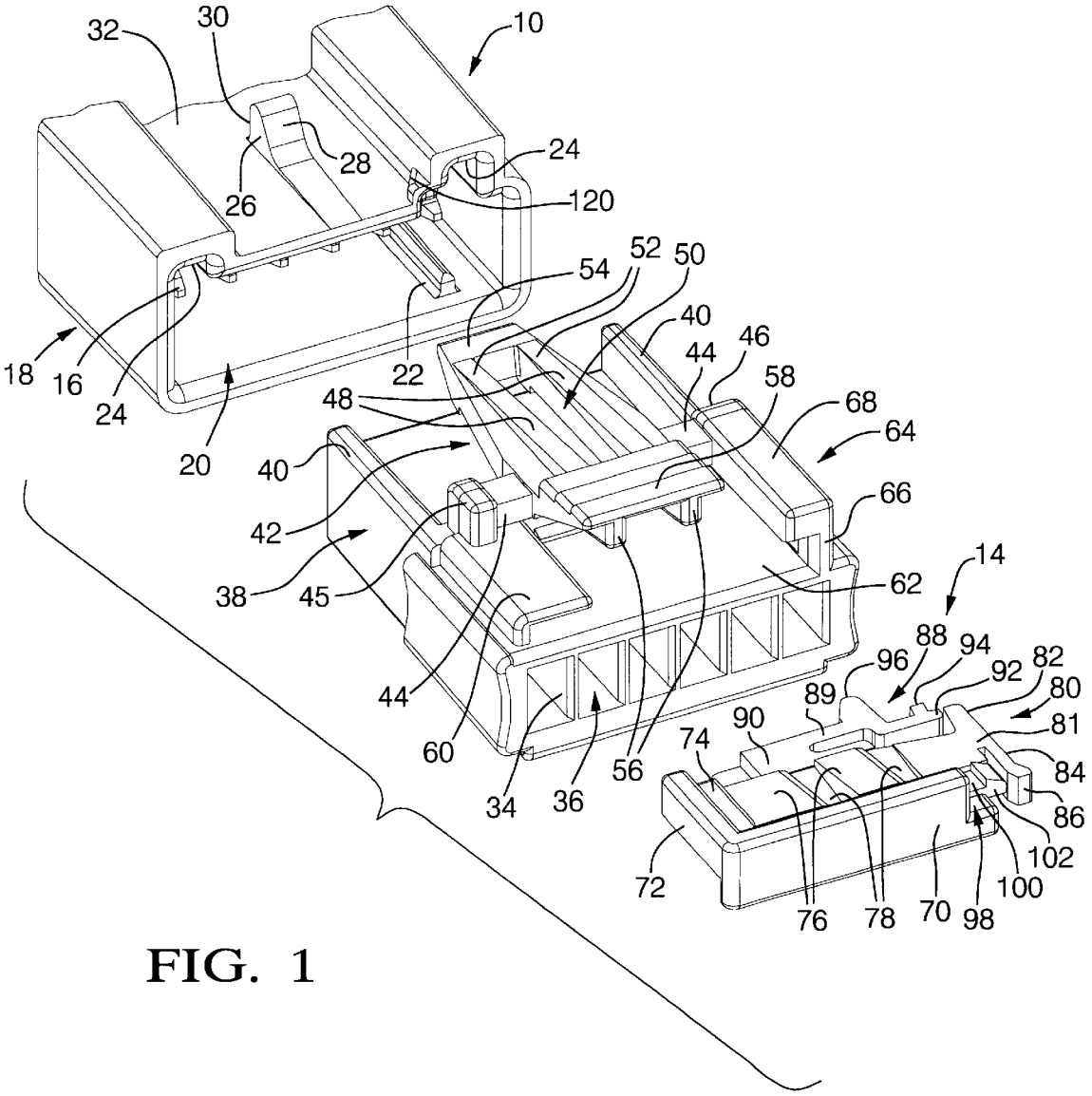
FIG. 1 is an exploded perspective view of a connector system utilizing a connector position assurance member (CPA) according to the present invention.

Referring to FIG. 1, a connector system according to the present invention includes a first connector part having a first (female) connector housing 10 for mating with a second connector part having a second (male) connector housing 12 and a connector position assurance (CPA) member 14. The first connector 10 may include a body portion 16 having a plurality of metal electrical terminals received therein and a shroud 18 extending from the body portion having an open end 20 for receiving a portion of the second connector 12. The first connector 10 may have a plurality of alignment features such as a guide rail 22 as well as guide channels 24 formed in the inside face of the shroud. A primary lock ramp 26 having a sloped front face 28 and a vertical locking shoulder 30 is positioned on the outside surface 32 of the shroud 18. If desired a recess 120 may be formed in the shroud to receive interference tab 96 on the CPA 14 as described hereafter.

The second connector 12 includes a body portion 34 having a plurality of cavities 36 for receiving a second set of metal electrical terminals (not shown) for mating with the first set of metal terminals in the first connector. The second connector 12 includes a male portion 38 extending from the body portion 34 and designed to be received in the open end 20 of the shroud 18 of the first connector 10. The male portion 38 may include guide ribs 40 for insertion into the guide channels 24 of the first connector and a guide channel on an underside (not shown) mateable with the guide rib 22 on the shroud 18.

A primary lock 42 is positioned on an outer surface of the second connector 12. Torsion arms 44 extend from two spaced apart support posts 45, 46 to the primary lock 42 to facilitate pivotal movement of the primary lock. The primary lock 42 includes two spaced apart elongated beams 48 having a slot 50 defined therebetween. The elongated beams 48 have a forward end 52 connected together by a bridge 54 and a free second end 56. The torsion arms 44 connect to the beams 48 between the forward end 52 and the second free end 56. A pump handle 58 extends across the top of the beams 48 near the free ends 56. A L-shaped guide member 60 extends upwardly from a top surface 62 of the male housing near one side. An U-shaped guide rail 64 extends upwardly from the top surface 62 of the male connector housing and includes a rear post 66 and a front support post 46 and a lip 68 extending therebetween.

A CPA 14 is provided having an elongated rear push plate 70 and a side push plate 72 extending therefrom generally at a 90 degree angle. A floor 74 extends from the rear and side push plates 70, 72 and includes a top surface having two spaced apart ramps 76 and two spaced apart grooves 78.

A first lock mechanism 88 extends from the floor of the CPA 14 and prevents the CPA from movement in a direction perpendicular to the mating direction of the connector housings when the CPA is in the pre-staged position. The first lock mechanism 88 includes a first flexible finger 89 having a first end 90 attached to the floor 74 and a second free end 92. A blocking tab 94 extends outwardly from the first finger 89 near the second end 92 and in the mating direction of the connector housings. The blocking tab 94 prevents the CPA from moving in a direction perpendicular to the mating direction of the housings 10, 12 when the CPA is in the pre-staged position and the housings are not fully mated. An interference tab 96 extends from the second finger 89 at a position spaced from the attached end 90 and in the mating direction of the connectors.

A second locking mechanism 80 extends from the floor and includes a second finger 81 having a first end 82 distant from the rear push plate 70 and a second flexible free end 84 nearer the rear push plate 70. A nub 86 extends outwardly from the second end 84 of the first finger. The second locking mechanism 80 prevents the CPA from moving in the axial direction (i.e., the mating direction of the connector housings) when the CPA is in the pre-staged position which will be described in further detail hereafter.

A third locking mechanism 98 extends from the floor and includes a third flexible finger 100 having a locking shoulder 102 for latching onto the second connector 12 when the CPA 14 is in the final fully seated position and prevents the CPA from being removed from the connector in a direction perpendicular to the mating direction of the connectors.

Figure 2:
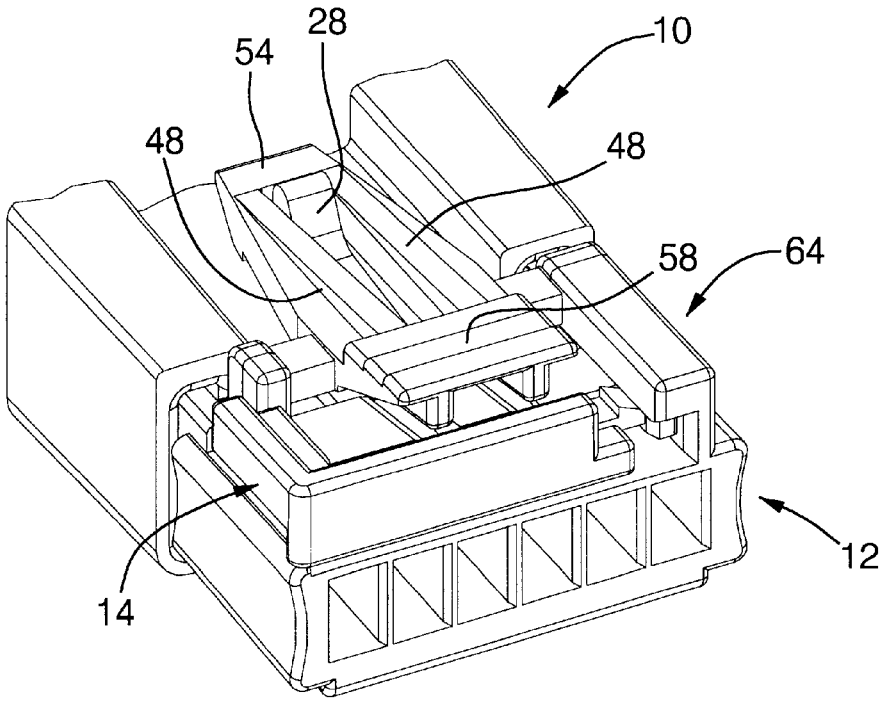
FIG. 2 is a perspective view of a connector system according to the present invention with the CPA in a pre-staged position.
Figure 3:
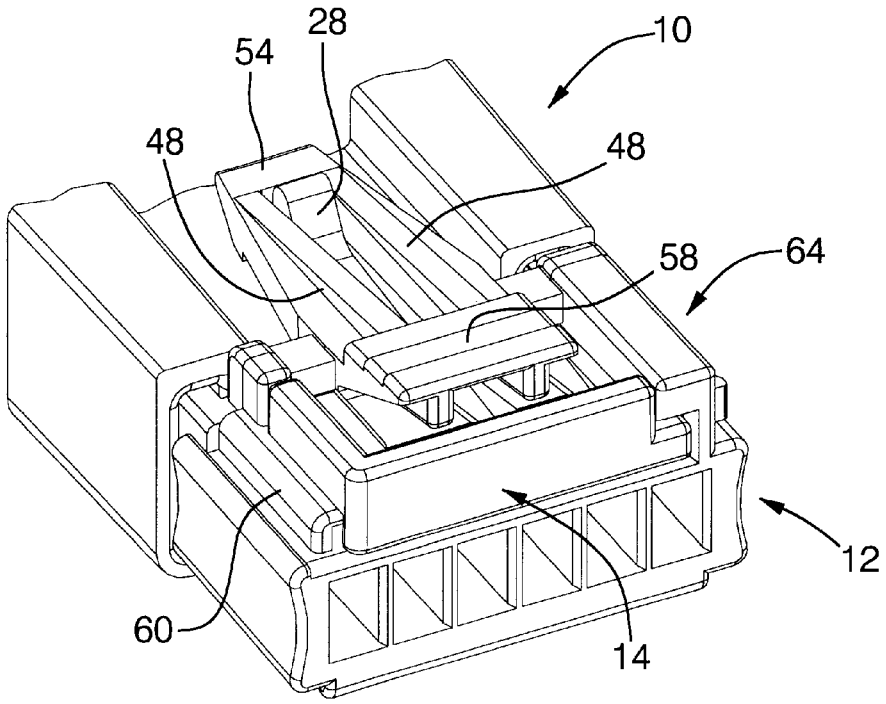
FIG. 3 is a connector system according to the present invention with the CPA is a final fully seated position.
Figure 4:
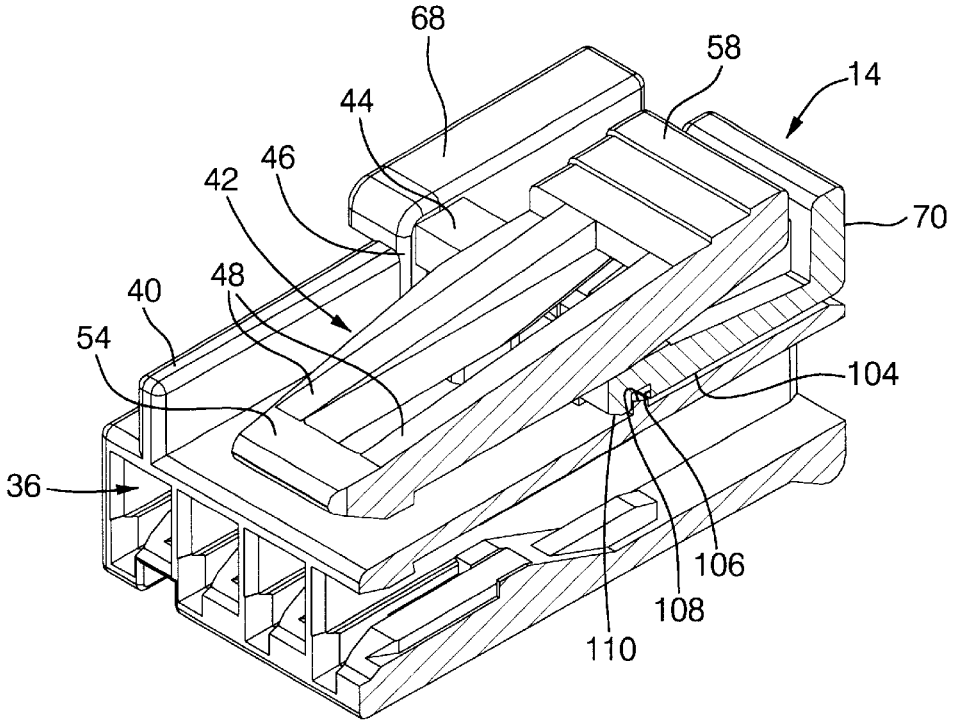
FIG. 4 is a perspective sectional view of a connector system according to the present invention illustrating the CPA in a pre-staged position.

As can be best seen by FIG. 4, the CPA 14 also includes a bottom surface 104 having a lock channel 106 formed therein and running transversely to the mating direction of the connectors for receiving a ramped rib 108 on the second connector housing 12. A chamfered lead-in surface 110 is provided at the front of the CPA 14 for riding over the ramped surface 108 and locking the CPA in a pre-staged position shown in FIGS. 2, 4, and 5. The lock channel 106 and ramped rib also help to guide the CPA when the CPA is moved in a direction perpendicular to the mating direction of the connector housings 10, 12.

Figure 5:
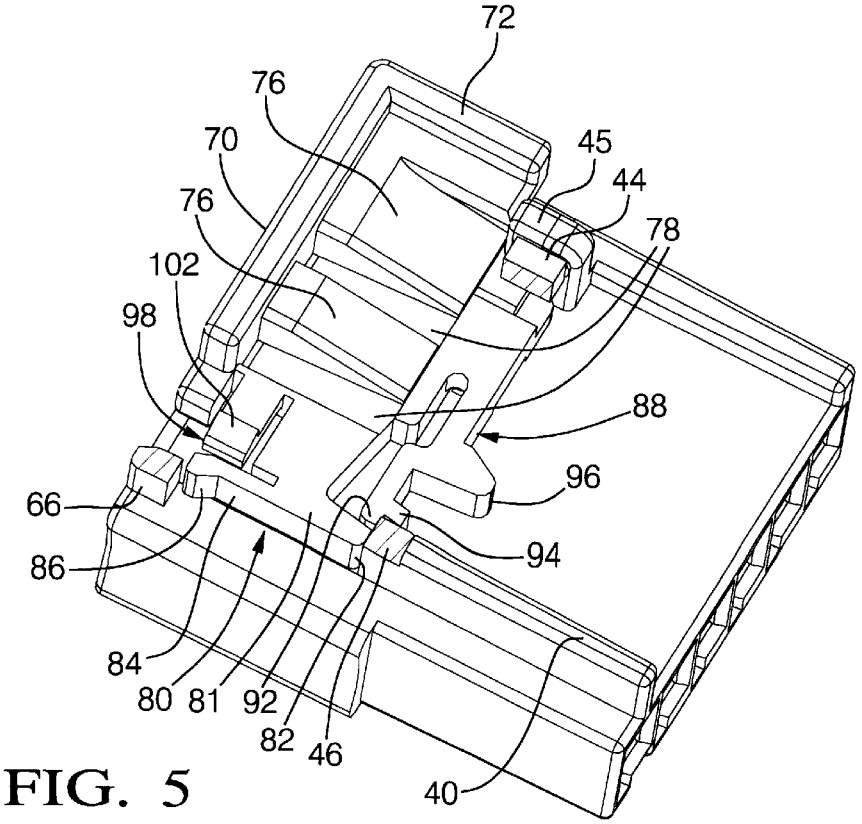
FIG. 5 is a perspective view with portions broken away of a connector system according to the present invention with the CPA in a pre-staged position.

Referring to FIG. 5, in this pre-staged position, the second lock mechanism 80 operates so that the first end 82 of the second finger 81 engages the support post 46 on the male housing 12 and the nub 86 extending from the second flexible end 84 of the second finger is in a blocking position with the rear posts 66 on the male housing 12 after the nub 86 has slid passed the rear post 66 and snapped back into an original position. Thus, the rear post 66 and nub 86 prevent the CPA from being withdrawn from the male housing in a rearward direction. As indicated earlier, in the pre-staged position the blocking tab 94 on the first finger also becomes positioned next to the support post 46 preventing the CPA from being pushed in a perpendicular direction to the mating direction of the connector housings. In this pre-staged position, the second free ends 56 of the primary lock beams 48 are aligned with respective grooves 78 formed in the top surface of the CPA 14 so that the primary lock mechanism is free to pivot.

Figure 6:
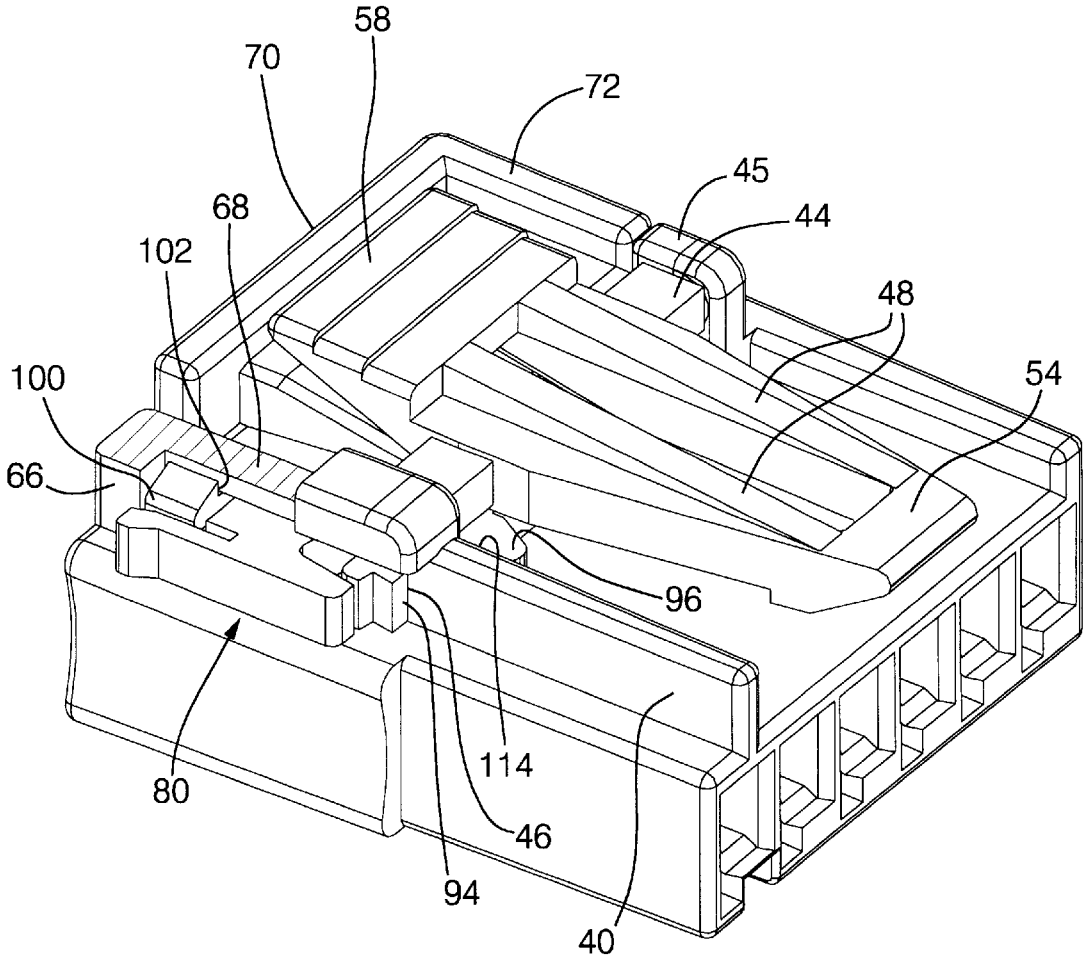
FIG. 6 is a perspective view with portions broken away of a connector system according to the present invention with the CPA in a final fully seated position.

Referring to FIGS. 1, 5 and 6, as the connector housings 10, 12 are mated together, the shroud 18 of the first connector 10 engages the interference tab 96 on the CPA 14 causing the first finger 89 to flex or bend backwards so that the blocking tab 94 is moved in a rearward direction out of engagement with the support post 46. At the same time, the bridge 52 of the primary lock rides up the sloped surface 28 on the primary lock ramp positioned on the first connector 10 and locks against the shoulder 30 of the primary lock ramp.

Once the primary lock 42 is locked onto the primary lock ramp 26, the assembler can move the CPA 14 to a final fully seated position by pushing on the side push plate 72 causing the CPA to slide in a direction perpendicular to the mating direction of the connectors 10, 12 so that the locking shoulder 102 of the third locking mechanism 98 latches onto the lip 68 on the second connector housing 12. The shroud 18 on the first connector 10 may be designed to maintain the first finger 89 in a bent back position or the shroud may have a recess 120 formed therein to receive the interference tab 96 allowing the first finger 89 to snap back so that the blocking tab 94 engages an outer surface of the support post 46 and the interference tab 96 engages an inside face 114 of the support post 46 capturing the support post 46 and preventing the CPA from moving in a perpendicular direction. The third flexible finger 100 also engages the rear posts 66 preventing the CPA from being moved in a rearward (axial) direction and the locking shoulder 102 engages the lip 68 on the second connector housing 12 preventing the CPA from being moved in a perpendicular direction back to the pre-staged position. As the CPA is moved to this final fully seated position, the second free ends 56 of the primary lock beams engage the ramped surfaces 76 on the CPA preventing the pump handle 58 from being depressed and unlocking the primary lock 42 from the primary lock ramp 26 thus locking the connectors together in a final position and preventing the connectors 10, 12 from being inadvertently unlocked.

A connector system according to the present invention eliminates the possibility the CPA can be mistakenly advanced to the final fully seated position before the connectors are mated. Further, the CPA according to the present invention is more likely to be assembled correctly than prior art CPAs because it requires an assembler to move the CPA in a direction that is perpendicular to the movement required to initially stage the CPA. The assembler is likely to be more cognizant of this perpendicular movement when performing it, because the movement requires a separate conscious action in a different direction as opposed to the prior art unidirectionally staged CPAs.

I claim:

1. An electrical connector system comprising:

first and second mateable connector housings and a connector position assurance member for bidirectional sliding movement on the second connector; the first connector housing having a primary lock ramp thereon and the second connector housing having a primary lock constructed and arranged for pivotal movement thereon and for locking against the primary lock ramp when the first and second connector housings are fully mated together;

the connector position assurance member being slidable on the second connector housing in a first direction co-linear with the mating direction of the connector housings to a pre-staged position when the connector housings are not fully mated and so that the primary lock is uninhibited from pivotal movement, and the connector position assurance member being slidable on the second connector housing in a second direction perpendicular to the mating direction of the connector housings to a final fully seated position wherein the connector position assurance member blocks the primary lock from pivotal movement preventing the primary lock from being disengaged from the primary lock ramp when the connector housings are fully mated;

the connector position assurance member having a first lock mechanism cooperative with one of the connector housings to temporarily lock the connector position assurance member from slidable movement on the second connector housing in the second direction perpendicular to the mating direction in the connector housings when the connector position assurance member is in the pre-staged position and the first and second connector housings are not fully mated, and a first lock mechanism being unlocked by one of the connector housings when the first and second connector housings are fully mated so that the connector position assurance member is slidable in a perpendicular direction to the final fully seated position.

2. An electrical connector system as set forth in claim 1 wherein the connector position assurance member further comprises a second locking mechanism locking against the second connector housing preventing the connector position assurance member from further slidable movement in a forward or rearward direction co-linear with the mating direction of the connector housings when the connector position assurance member is in the pre-staged position.

3. An electrical connector system as set forth in claim 1 wherein the connector position assurance member further comprises a third lock mechanism for locking against the second connector housing preventing the connector position assurance member from being slidably removed in a perpendicular or rearward direction when the connector position assurance member is in the final fully seated position.

4. An electrical connector system comprising:

first and second mateable connector housings and a connector position assurance member for bi-directional sliding movement on the second connector; the first connector housing having a primary lock ramp thereon and the second connector housing having a primary lock constructed and arranged for pivotal movement thereon and for locking against the primary lock ramp when the first and second connector housings are fully mated together;

the connector position assurance member being slideable on the second connector housing in a first direction co-linear with the mating direction of the connector housings to a pre-staged position when the connector housings are not fully mated and so that the primary lock is uninhibited from pivotal movement, and the connector position assurance member being slideable on the second connector housing in a second direction perpendicular to the mating direction of the connector housings to a final fully seated position wherein the connector position assurance member blocks the primary lock from pivotal movement preventing the primary lock from being disengaged from the primary lock ramp when the connector housings are fully mated;

the connector position assurance member having a first lock mechanism cooperative with one of the connector housings to temporarily lock the connector position assurance member from slideable movement on the second connector housing in the second direction perpendicular to the mating direction in the connector housings when the connector position assurance member is in the pre-staged position and the first and second connector housings are not fully mated, and a first lock mechanism being unlocked by one of the connector housings when the first and second connector housings are fully mated so that the connector position assurance member is slidable in a perpendicular direction to the final fully seated position; and the connector position assurance member having an elongated rear push plate, a side push plate extending generally at a 90 degree angle to the rear push plate, and a floor extending from the rear and side push plates.

5. An electrical connector system as set forth in claim 4 wherein the second connector housing comprises a ramped rib running transversely to the mating direction of the connectors and the connector position assurance member includes a groove formed in a bottom face of the floor for receiving the ramped rib on a second connector housing when the connector position assurance member is slid into the pre-staged position.

6. An electrical connector system comprising:

first and second mateable connector housings and a connector position assurance member for bi-directional sliding movement on the second connector; the first connector housing having a primary lock ramp thereon and the second connector housing having a primary lock constructed and arranged for pivotal movement thereon and for locking against the primary lock ramp when the first and second connector housings are fully mated together;

the connector position assurance member being slideable on the second connector housing in a first direction co-linear with the mating direction of the connector housings to a pre-staged position when the connector housings are not fully mated and so that the primary lock is uninhibited from pivotal movement, and the connector position assurance member being slideable on the second connector housing in a second direction perpendicular to the mating direction of the connector housings to a final fully seated position wherein the connector position assurance member blocks the primary lock from pivotal movement preventing the primary lock from being disengaged from the primary lock ramp when the connector housings are fully mated;

the connector position assurance member having a first lock mechanism cooperative with one of the connector housings to temporarily lock the connector position assurance member from slideable movement on the second connector housing in the second direction perpendicular to the mating direction in the connector housings when the connector position assurance member is in the pre-staged position and the first and second connector housings are not fully mated, and a first lock mechanism being unlocked by one of the connector housings when the first and second connector housings are fully mated so that the connector position assurance member is slidable in a perpendicular direction to the final fully seated position; and the first lock mechanism extending from a floor of the connector position assurance member and including a first flexible finger having a first end attached to the floor and a second free end, and a blocking tab extending outwardly from the first finger near the second free end and in a direction co-linear with the mating direction of the connector housings, and an interference tab extending from the first finger at a position spaced from the attached end and in the mating direction of the connector housings and constructed and arranged so that first connector housing engages the interference tab when the connector housings are fully mated unlocking the first lock mechanism and allowing the connector position assurance member to be slid in the second direction perpendicular to the mating direction of the connector housings.

7. An electrical connector system as set forth in claim 2 wherein the second lock mechanism extends from a floor and includes a second finger having a first end distance from a rear push plate and a second flexible free end nearer the rear push plate and a nub extending outwardly from the second end of the second finger.

8. An electrical connector system as set forth in claim 7 wherein the second connector housing includes a first and second shoulder constructed and arranged so that the first end of the second finger on the second lock mechanism engages the first shoulder and the nub on the second finger of the second lock mechanism engages the second shoulder when the connector position assurance member is in the pre-staged position thus preventing the connector position assurance member from further slidable movement in the mating direction of the connector housings.

9. An electrical connector system as set forth in claim 6 wherein the second connector housing comprises a first post extending upwardly from a top surface of the connector housing and positioned so that the blocking tab engages the first post when the connector position assurance member is in the pre-staged position and so that the first post is received between the blocking tab and the interference tab when the connector position assurance member is in the final fully seated position thus preventing movement of the connector position assurance member in a direction perpendicular to the mating direction of the connector housings.

10. An electrical connector system as set forth in claim 3 wherein the third locking mechanism extends from a floor and includes a third finger having a locking shoulder for latching onto the second connector housing when the connector position assurance member is in the final fully seated position thus preventing the connector position assurance member from being removed from the second connector housing in a direction perpendicular to the mating direction of the connector housings.

11. An electrical connector system as set forth in claim 1 wherein the primary lock is pivotally connected to the second housing between first and second ends of the primary lock, the first end of the primary lock having a lock shoulder for engaging the primary lock ramp and a second end having a pump handle capable of being depressed and causing the first end to be elevated to unlock from the primary lock ramp, and the connector position assurance member having a top surface with at least one recess formed therein and aligned with the second end of the primary lock when the connector position assurance member is in the pre-staged position and so that the primary lock is uninhibited from pivotal movement, and the connector position assurance member having a ramp positioned to be aligned with the second end of the primary lock when the connector position assurance member is in the final fully seated position so that the ramp blocks the primary lock from pivotal movement and prevents the primary lock from being inadvertently unlocked from the primary lock ramp.

12. An electrical connector system as set forth in claim 11 wherein the primary lock comprises a pair of spaced apart beams connected at a first end by a bridge providing the lock shoulder for engaging the primary lock ramp and each beam having a second end underlying the pump handle and the connector position assurance member comprising two recesses on the top surface each positioned to be aligned with the second end of one of the beams when the connector position assurance member is in the pre-staged position.

* * * * *